United States Patent [19]

Nenov et al.

[11] 4,048,025

[45] Sept. 13, 1977

[54] ELECTROLYTIC PROCESS FOR SILVER OXIDATION

[75] Inventors: Dimiter Panayotov Nenov; Verginia Ilieva Danova, both of Sofia, Bulgaria

[73] Assignee: VMEI "LENIN" — NIS Research Institution, Sofia, Bulgaria

[21] Appl. No.: 654,245

[22] Filed: Feb. 2, 1976

[51] Int. Cl.[2] ..... C25D 11/00; C25D 9/06

[52] U.S. Cl. ..... 204/56 R

[58] Field of Search ..... 204/56 R

[56] References Cited

PUBLICATIONS

"The deposition potential of Co. Ni & Cu from chloride solutions, " The Electrochem Soc., Oct. 6, 1941, pp. 102–105.

*Primary Examiner*—R. L. Andrews

*Attorney, Agent, or Firm*—E. Janet Berry; Lawrence Rosen

[57] ABSTRACT

A process for oxidation of silver and silver-plated articles having a violet or dark red decorative corrosion resistant coating by using an alternating current and as the electrolyte, a cupric chloride solution of concentration of 5 to 15 g/l.

1 Claim, No Drawings

ELECTROLYTIC PROCESS FOR SILVER OXIDATION

The present invention relates for an electrolyte designed for silver oxidation by means of alternating current of 50 hertz, which is applied for decorative and electrotechical aims, for example in radioelectronics, in radiolocation, for domestic needs and others.

The silver and the silver plated articles are brown-red coloured under the action of the air contained hydrogen sulphide. The formed coating is of no decorative value. Its formation can be obviated by different manners.

Different methods are known for the production of protective-decorative, inorganic, nonmetallic, passivating coatings on the silver, obtained by chemical and electrochemical means. According to the most widly spread recent chemical methods, the passivation of the silver is achieved usually in aqueous solutions of chromates, chlorides and sulphur-containing salts at 60–80° C and a treatment duration of 5 to 20 minutes.

The electrochemical passivation of the silver is recently accomplished by means of the anodic treatment of the articles in electrolytes containing chromate, sulphide and molybdate ions at a current density of 0.05 a/dm$^2$ and a temperature of 15°–25° C for 3–10 minutes.

Methods are known also for the silver oxidation using an alternating current of industrial frequency of 50 hertz in aqueous salt solutions. Such an example is provided by the oxidation of the silver in an aqueous solution containing 60 g/l sodium chloride at a temperature of 40°–80° C for 1 to 5 minutes and a current density of 5 to 50 a/dm$^2$ or in an aqueous solution containing 0,025 to 1 g/l potassium permanganate at a temperatureof 40°–80° C, a current density of 0,006 to 1 a/dm$^2$ for 5 to 30 minutes. In both cases a corrosion-resistant, high quality black coating is achieved.

The comparison of the most often used electrolytes for the chemical and the electrochemical passivation of the silver and the silver plated articles shows, that the electrochemical passivation makes use of lower temperatures, saves time and reactants. Independantly of its advantages, the electrochemical passivation has some disadvantages, as for example the need of a direct current source. Each of the aforementioned methods has its positive and negative aspects, which are to be taken into account, when the choice and the application for every special case is to be done.

The object of the present invention is to create an electrolyte for the production of a violet or dark-red, corrosion-resistant and mechanically-resistant, dense, oxide coating on the silver without the need of a direct current source, making use of a simplified technology and cheap chemical reactants.

The electrolyte, according to the present invention, contains 2 to 15 g/l cupric chloride and is appropriate to be applied at a temperature of 60°–90° C and a current density from 0.025 to 50 a/dm$^2$ for .5 to 30 minutes of an alternating current of 50 hertz. The invention could be explained by the following examples:

EXAMPLE 1

The silver and the silver-plated articles are immersed into the electrolyte containing 5 g/l cupric chloride at a temperature of 80° C. A current of a frequency of 50 hertz and density of 0,25 a/dm$^2$ is applied and the oxidation is carried out for 10 minutes. Thereafter the oxidated articles are taken out from the solution, rinsed in running water and dried. The obtained oxide coatings are violet coloured, non-porous, corrosion and mechanically resistant.

EXAMPLE 2:

The silver and the silver-plated articles are immersed into the electrolyte containing 15 g/l cupric chloride at a temperature of 80° C. A current of a frequency of 50 hertz and density of 50 a/dm$^2$ is applied and the oxidation is carried out for 20 minutes. Thereafter the oxidated articles are taken out from the solution, rinsed in running water and dried. The obtained oxide coatings are dark-red coloured, non-porous, corrosion and mechanically resistant.

What we claim is:

1. Process for oxidation of silver and silver-plated articles by means of an alternating current of 50 hertz, wherein the electrolyte employed is a solution of cupric chloride having a concentration of 5 to 15 g/l and whereby a violet or dark red decorative corrosion resistant coating is obtained.

* * * * *